US010830565B2

(12) United States Patent
Sloff et al.

(10) Patent No.: US 10,830,565 B2
(45) Date of Patent: Nov. 10, 2020

(54) METHOD OF MAKING A COLORED PROJECTILE

(71) Applicants: Michael Sloff, Saint Marys, PA (US); Brian Benini, Kersey, PA (US)

(72) Inventors: Michael Sloff, Saint Marys, PA (US); Brian Benini, Kersey, PA (US)

( * ) Notice: Subject to any disclaimer, the term of this patent is extended or adjusted under 35 U.S.C. 154(b) by 0 days.

(21) Appl. No.: 16/279,893

(22) Filed: Feb. 19, 2019

(65) Prior Publication Data

US 2019/0257629 A1 Aug. 22, 2019

Related U.S. Application Data

(60) Provisional application No. 62/660,001, filed on Apr. 19, 2018, provisional application No. 62/632,466, filed on Feb. 20, 2018.

(51) Int. Cl.

| | |
|---|---|
| ***F42B 12/74*** | (2006.01) |
| ***C23C 24/04*** | (2006.01) |
| ***F42B 33/00*** | (2006.01) |
| ***C23C 24/02*** | (2006.01) |
| ***F42B 12/36*** | (2006.01) |
| ***F42B 33/14*** | (2006.01) |
| ***F42B 12/80*** | (2006.01) |

(52) U.S. Cl.

CPC ..... *F42B 33/00* (2013.01); *C23C 24/02* (2013.01); *C23C 24/045* (2013.01); *F42B 12/367* (2013.01); *F42B 12/80* (2013.01); *F42B 33/14* (2013.01)

(58) Field of Classification Search

CPC ..... F42B 33/00; F42B 33/14; F42B 12/80; F42B 12/367; F42B 12/74; F42B 5/02; C23C 24/045; C23C 24/02; C08K 3/08; C08K 3/22; C08L 21/00

USPC ..... 86/55

See application file for complete search history.

(56) References Cited

U.S. PATENT DOCUMENTS

| | | | | |
|---|---|---|---|---|
| 3,442,691 | A | 5/1969 | Pearson | |
| 5,597,975 | A | 1/1997 | Satow | |
| 10,309,756 | B2 * | 6/2019 | Sloff | F42B 12/367 |
| 2003/0127011 | A1 | 7/2003 | Mackerell et al. | |
| 2009/0126602 | A1 * | 5/2009 | Murphy | C09B 67/0097 106/251 |
| 2009/0254171 | A1 * | 10/2009 | Heikkila | C08K 3/08 623/1.15 |
| 2010/0037794 | A1 | 2/2010 | Authement, Sr. | |
| 2017/0205215 | A1 * | 7/2017 | Sloff | F42B 12/74 |

OTHER PUBLICATIONS

International Search Report of PCT/US2019/018646 issued from European Patent Office in the related international application.

* cited by examiner

*Primary Examiner* — Michael D David

(74) *Attorney, Agent, or Firm* — Finnegan, Henderson, Farabow, Garrett & Dunner, LLP

(57) ABSTRACT

A method of making a colored projectile is disclosed, as well as the projectile made thereby. In an embodiment, the method comprises mechanically plating a colored metal, typically in powdered form, onto the surface of a projectile, such as a frangible, copper-based bullet, a full metal jacket bullet or a total metal jacket bullet. The disclosed plating process imparts a uniform, desired color to the surface of the plated projectile.

20 Claims, 2 Drawing Sheets

METHOD OF MAKING A COLORED PROJECTILE

CROSS-REFERENCE TO RELATED APPLICATIONS

This application claims the benefit of priority to Provisional Applications 62/632,466, filed Feb. 20, 2018 and 62/660,001, filed Apr. 19, 2018. The entire contents of both applications are expressly incorporated herein by reference.

FIELD OF USE

The present disclosure generally relates a method of making a colored projectile, such as a frangible bullet, a FMJ (Full metal Jacket) or TMJ (Total Metal Jacket), using a mechanical plating process. The present disclosure also relates to colored projectiles made using the disclosed process.

BACKGROUND

There are a variety of applications in which a colored projectile could assist in identification of ammunition, a shooter or both. For example, in training applications, personnel being trained may not be able to distinguish frangible training rounds from their standard duty ammunition. The ability to distinguish frangible training rounds from their standard duty ammunition can improve safety for range officers, as well as those being trained. It can also avoid using the wrong ammunition in the field. To aide in product recognition, it would be beneficial to have a colored topcoat to easily distinguish between ammunition calibers.

While methods of plating or coating projectiles have been attempted in the past, they have been limited by a variety of factors including: economic feasibility, issues with finished surface smoothness, uniformity of coating and the like.

The disclosed method of making a colored projectile is directed to overcoming one or more of the problems set forth above and/or other problems of the prior art.

SUMMARY

There is disclosed a method of making a colored projectile. In an embodiment, the method comprises mechanically plating a metal onto the surface of a projectile, such as a frangible metal bullet, full metal jacket or total metal jacket. In an embodiment, plating may comprise adding the projectile to a container comprising an aqueous slurry comprising at least one acid, at least one plating-assisting agent, and at least one particulate plating metal; rotating the container to agitate the projectile in the slurry for a time sufficient to plate the particulate plating metal on the surface of the projectile to form a plated projectile; rinsing the plated projectile; and treating the rinsed projectile with a trivalent chromium compound to impart a desired color to the surface of said plated projectile.

There is also disclosed a colored projectile, such as a frangible bullet or a jacketed bullet, made by the described method.

Aside from the subject matter discussed above, the present disclosure includes a number of other features such as those explained hereinafter. Both the foregoing description and the following description are exemplary only.

DETAILED DESCRIPTION

The present disclosure provides a method and materials by which mechanical plating processes can be adapted to plate a metal, such as zinc, tin, copper, or aluminum that imparts a desired color to a projectile, including a frangible metal bullet or a jacketed bullet, such as a full metal jacket or total metal jacket bullet.

Mechanical Plating—As used herein, Mechanical Plating, also known as Impact Plating, is a plating process that imparts the coating by cold welding fine metal particles to a projectile. It is distinct and advantageous over other plating methods, such as electroplating, in terms of costs and ease of operation.

Full Metal Jacket Bullet—As used herein, a Full Metal Jacket ("FMJ") bullet is intended to mean a small-arms projectile consisting of a soft core, such as lead, that is encased in a shell of harder metal, such as gilding metal. In non-limiting embodiments, the gliding metal comprises a copper-nickel alloy or a steel alloy. In a FMJ, the base of the bullet comprises exposed lead.

Total Metal Jacket Bullets—As used herein, a Total Metal Jacket ("TMJ") (also known as "Full Metal Case") bullet is fully covered with a shell of the previously described harder metal, such as a copper plating. Unlike a FMJ in which the base of the bullet comprises exposed lead, in the TMJ the bullet is fully covered with copper plating.

Frangible Metal Bullet—As used herein, a Frangible Metal Bullet is defined as a projectile that fragments upon impact with a hard surface into particles weighing 5% or less of its initial weight. The frangible characteristics are a result of a microstructure that comprises metal particles that are not fully sintered together.

In an embodiment, there is described a non-frangible projectile that is colored according the method described herein. The non-frangible projectile is partially-to-completely sintered and is comprised substantially of copper, such as at least 95% by weight of Copper, such as at least 97% by weight of copper. In an embodiment the projectile is comprised of pure copper, and thus is substantially free of intermetallics. As used herein, "pure copper" is intended to mean at least 98.50% by weight copper.

Figure 1A:
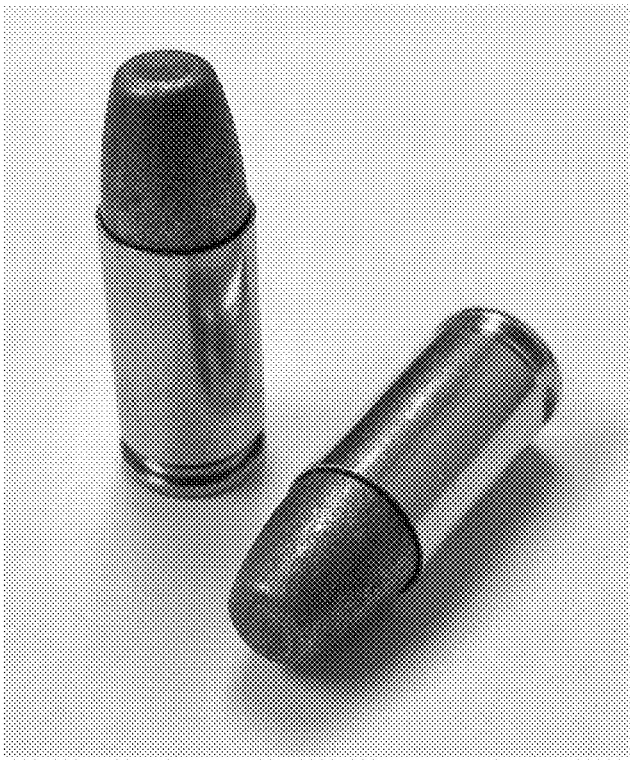
FIG. 1A is a photograph of a colored pistol cartridge made according to the present disclosure.
Figure 1B:
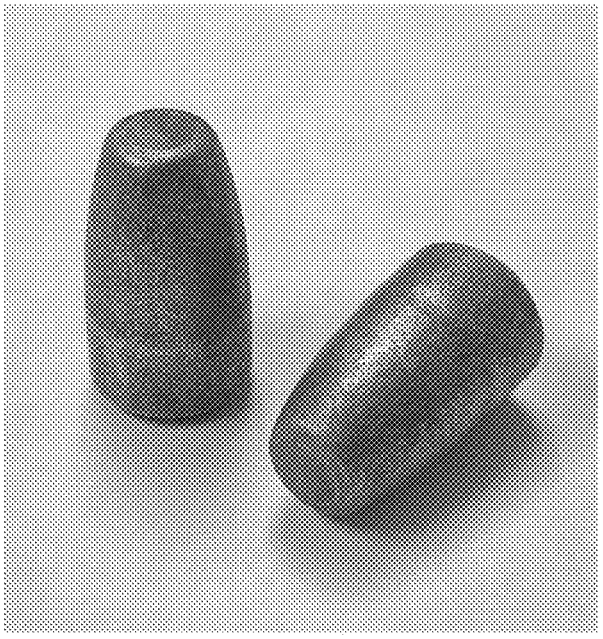
FIG. 1B is a photograph of a colored bullet made according to the present disclosure.

In one embodiment, there is disclosed a method of making a colored projectile, such as shown in FIG. 1A, which is a photograph of a green-colored pistol cartridge. The method described herein comprises plating a metal onto the surface of a projectile. In an embodiment, the projectile comprises a compacted mixture of copper powder comprising partially sintered particles that are physically bonded to each other to form a cohesive and ductile microstructure. In one embodiment, there is disclosed a method of making a colored projectile, such as shown in FIG. 1B, which is a photograph of a green-colored bullet.

Figure 2:
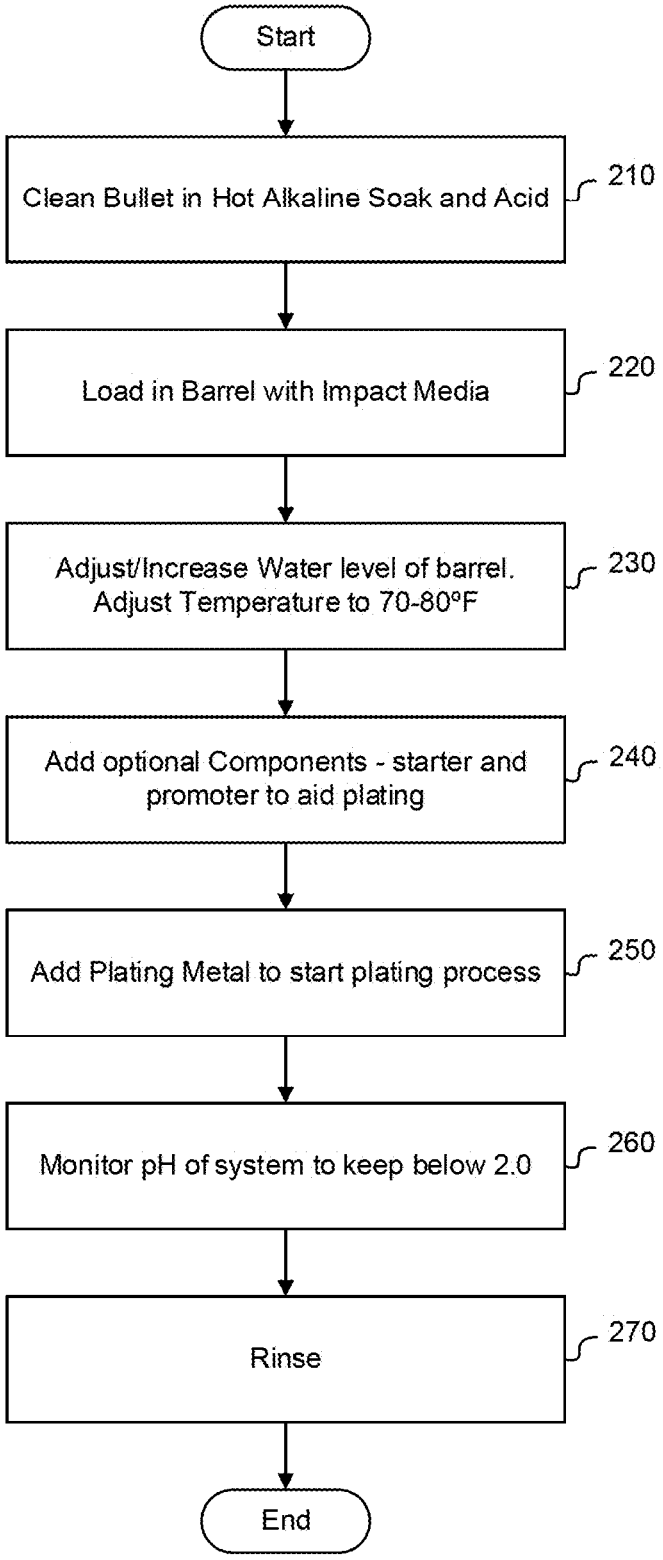
FIG. 2 is a flowchart of an embodiment of the plating process described herein.

With reference to FIG. 2, the plating method may start with pre-treating the projectiles to be plated to clean the surface of unwanted contaminants, such as oils, oxides, scale, and combinations thereof (210). Non-limiting example of the pre-treatment steps comprise placing the projectiles in at least one alkaline-based solution, acid-based solution, water rinse, or combinations thereof. Parts are usually cleaned in an alkaline soak cleaner, and then dipped in an acid pickle, before being rinsed. Clean parts which are free from oil and scale are loaded to a plating barrel. Parts can also be cleaned in the barrel using a commercial Descaler/Degreaser specifically designed for cleaning parts in the barrel prior to mechanical plating. In some embodiments, parts may be plated without cleaning.

In one embodiment, pre-treatment in an acid-based solution occurs in the container used for plating prior to adding at least one plating-assisting agent, or at least one particulate plating metal to the container. In one embodiment, the acid-based solution comprises at least one acid chosen from sulfuric, hydrochloric and citric acids.

The projectiles described herein may be agitated in a slurry comprising at least one acid to remove oxides from the surface of the projectile prior to the addition of at least one plating agent, and at least one particulate plating metal.

In one embodiment, impact media can be loaded to the barrel or tumbler to assist in plating (220). In one embodiment, the barrel or tumbler is constructed of steel or stainless steel and lined with an acid and abrasion resistant material, such as neoprene, polypropylene, or polybutylene.

Non-limiting examples of the impact media include a mixture of varying sizes of spherical glass beads ranging from 0.4 mm to 5.0 mm, e.g., approximately 4 mesh up to 60 mesh. In one embodiment, equal quantities by volume of glass beads and parts are loaded to the barrel, although heavier parts or heavier coatings of more difficult parts require a higher media-to-parts ratio. When used, the larger sizes of the impact media 'cold welds' the metal plating powder to the projectile surface.

If an impact media is used in the plating barrel, the water level in the barrel may need to be adjusted to an appropriate level for the parts to be plated. In one embodiment, the water level is adjusted to be approximately 1 to 2 inches above the media/parts/water mix when the barrel is rotating at the proper speed. In some embodiments, the temperature of the media/parts/water mix should be in the range of 70° F. to 80° F. (230). Lower temperatures result in slower plating whereas higher temperatures will result in more rapid plating.

In various embodiments, the aqueous slurry may also comprise at least one plating-assisting agent, at least one particulate plating metal or combinations thereof (240).

Next, a small quantity of metal is added to the barrel to produce a coating (250). As described, the plating slurry may further comprise at least one plating-assisting agent comprising a coppering agent, an accelerator, a chemical promoter or combinations thereof, in addition to the plating metal. Non-limiting examples of the particulate plating metal include zinc, tin, copper, aluminum, and chromium. These plating metals are typically in powder or particulate form. In one embodiment, the chromium comprises chromium compound that imparts a desired color chosen from red, blue, green, yellow, orange, purple, and combinations thereof.

In one embodiment, the chromium compound is a trivalent chromium compound. Thus, in an embodiment, the disclosed method comprises rinsing the plated projectile and treating the rinsed projectile with a trivalent chromium compound to impart a desired color to the surface of the plated projectile.

It is appreciated that the projectiles may undergo more than one plating process in order to achieve a desired color. The multiple plating processes may be used with the same particulate plating metal or with a different one, depending on the desired color. Once the desired color is achieved, an additional plating metal can be added to the barrel in an appropriate quantity for the surface area of parts in the barrel and the thickness of coating desired. In an embodiment, plating metal is a fine dust, such as ranging from 3 to 20 microns in diameter. During the plating process, pH is monitored carefully by the plating operator such that the pH is not allowed to rise above a value of 2.0, since plating ceases above that value.

Frangible Bullet

While the disclosed method can be used to impart color to any metal projectile, in one embodiment, the projectile comprises a frangible metal bullet. The frangible bullet encompassed by the present disclosure can be made by pressing copper powder in a mold to form a green compact. Pressing is generally performed to achieve a uniform density ranging from 7.0 to 8.2 g/cc, such as from 7.2 to 8.2 g/cc, from 7.5 to 8.2 g/cc, or from 7.8 to 8.2 g/cc. Pistol products typically have ranges less than 7.6 g/cc while rifle and rimfire products typically have ranges greater than 7.6 g/cc up to 8.2 g/cc.

Next, the process includes heating the green compact to below the melting point of copper to achieve physical bonding of the copper particles in the green compact, and to form a copper bullet comprising cohesive microstructure. Heat treating typically occurs below the melting point of copper, and in some cases, below the sintering temperature of copper. For example, non-limiting temperature ranges which may be used in the described method include from 1200° F. to 1600° F., such as from 1250° F. to 1450° F., or from 1350° F. to 1450° F. Heat treating may occur in a reducing atmosphere, such as in N2, for a time sufficient to achieve desired metallurgical properties. Such times typically range from 15 to 90 minutes, such as 20 to 60 minutes, with 20 to 40 minutes being noted as useful. In various embodiments, the heat treating step is performed in reducing atmosphere. For example, in non-limiting embodiments the reducing atmosphere may comprise any oxygen reducing gas, such as hydrogen (e.g., H2), nitrogen, or carbon monoxide. Pistol products typically have ranges from 1250 to 1450° F., such as from 1300° F. to 1400° F. with time at temperature from 20 to 50 minutes. In contrast, rifle and rimfire products have ranges from 1300 to 1450° F., such as 1350° F. to 1450° F. with time at temperature from 60 to 90 minutes.

In one embodiment, there is disclosed a lead-free projectile comprising a compacted mixture of copper powder, wherein the copper powder comprises particles that are physically bonded to each other to form a cohesive and ductile microstructure. A cohesive and ductile microstructure allows for crimping and rifling. While the copper powder particles can be sintered, alternative or additional embodiments include copper powder particles that are bonded by pre-sintering or partial sintering. This ability to vary the bond strength between particles from sintered to pre-sintered states allows for flexibility in the frangibility properties of the resulting projectile. As used herein, "partial sintering" or "pre-sintering" is intended to mean that some neck growth has developed between particles; however, porosity remains between adjacent particles.

In one embodiment, the physical bond between the copper powder particles generally comprises metallic bonds.

In an embodiment the copper powder can be mixed with at least one additional metal powder comprising an alloy of copper. When alloying elements are present, the resulting bullet may comprise intermetallic alloys (also simply referred to as "intermetallics") of the various alloying elements. Examples of such alloying elements that can be included in addition to copper are iron, nickel, chromium, tin, zinc, and their alloys, and intermetallic compounds of these metals. Non-limiting examples of alloys that can be used in addition to copper powder are brass, bronze, and combinations thereof. In one embodiment the copper powder includes a sintering aid. In another embodiment the sintering aid is phosphorous or boron.

In another embodiment the projectile is comprised of pure copper, and thus is substantially free of intermetallics. As used herein, "pure copper" is intended to mean at least 98.50% by weight copper, such as at least 99% by weight copper, or even at least 99.5% by weight copper. Whether containing pure copper or additional alloying elements, the projectile described herein generally exhibits a density ranging from 5.8 to 8.2 g/cc, such as 6.5 to 8.2 g/cc, 7.0 to 8.2 g/cc, such as from 7.2 to 8.2 g/cc, from 7.5 to 8.2 g/cc, or even from 7.8 to 8.2 g/cc. Pistol products typically have ranges less than 7.6 g/cc while rifle and rimfire products typically have ranges greater than 7.6 g/cc up to 8.2 g/cc.

In an embodiment the projectile may comprise an admixed lubricant that aids in processing, primarily in the pressing steps that allows in ease of pressing and release from the mold. Non-limiting examples of the lubricant that can be used include molybdenum disulfide, zinc stearate, lithium stearate, carbon, synthetic wax, such as N,N' Ethylene Bis-Stearamide or N,N' Distearoylethylenediamine (sold as Acrawax® by Lonza), polytetrafluoroethylene (sold as Teflon® by DuPont Co.), polyethylene, polyamide, and polyvinyl alcohol, and combinations of any of the foregoing.

Colored Frangible Bullet and Method of Making the Same

One embodiment of the present disclosure includes a method of making a colored frangible bullet, such as a desired color chosen from red, blue, green, yellow, orange, purple, and combinations thereof. The disclosed method may comprise mechanically plating a metal onto the surface of a frangible metal bullet, the frangible metal bullet comprising a compacted mixture of copper powder comprising partially sintered particles that are physically bonded to each other to form a cohesive and ductile microstructure.

The plating step described in this embodiment comprises adding the frangible metal bullet to a container comprising an aqueous slurry, which comprises at least one acid, at least one plating-assisting agent, and at least one particulate plating metal, such as zinc, tin, copper, or aluminum.

The method of making a colored frangible bullet further comprises rotating the container to agitate the frangible metal bullet in the slurry for a time sufficient to plate the particulate plating metal on the surface of the frangible metal bullet to form a plated frangible metal bullets.

The method of making a colored frangible bullet further comprises rinsing the plated frangible metal bullet and treating the rinsed bullet with a composition comprising at least one chromium compound, water-soluble polymer and dyes to the surface of the plated frangible metal bullets.

In an embodiment of the method described herein, the frangible metal bullets are pre-treated prior to plating to clean the surface of unwanted contaminants, such as oils, oxides, scale, and combinations thereof.

In an embodiment of the method described herein, the pre-treatment steps comprise placing the bullets in at least one alkaline based solution, acid based solution, water rinse, or combinations thereof.

In one embodiment, pre-treatment in an acid based solution occurs in the container used for plating prior to adding at least one plating-assisting agent, or at least one particulate plating metal to the container.

In an embodiment, the acid based solution comprises at least one acid chosen from sulfuric, hydrochloric and citric acids. Agitating the frangible metal bullets described herein is performed for a time sufficient to remove oxides from the surface of the bullet prior to the addition of at least one plating agent, and at least one particulate plating metal.

The agitating step described herein may further comprise adding impact media to the container prior to rotating, such as a mixture of spherical glass beads ranging from 4 mesh to 60 mesh. In an embodiment, the impact media may be added in a substantially equal quantity, by volume, to the frangible metal bullets.

The temperature of the solution in the container ranges from 70° F. to 80° F.

In an embodiment, the at least one particulate plating metal has a diameter ranging from 3 to 20 microns in diameter.

In an embodiment, the aqueous slurry used for plating, e.g., which includes the plating metal, has a pH of 2.0 or less.

The aqueous slurry may include at least one plating-assisting agent, such as a coppering agent, an accelerator, a chemical promoter or combinations thereof.

In an embodiment, the frangible metal bullet contains a cohesive microstructure that is substantially free of intermetallics. The described colored frangible metal bullet exhibits a density ranging from 7.0 to 8.2 g/cc. The frangible metal bullet may also be lead free.

In one embodiment, the method may comprise at step to cannelure a groove into the frangible metal bullet. Thus, in an embodiment, the frangible metal bullet includes a cannelure.

There is described a frangible colored bullet, such as a pistol product, made by the method described herein. In one embodiment, the projectile described herein is used in a pistol product. To exemplify this product, reference is made to FIG. 1A and FIG. 1B. Focusing on FIG. 1A, there is shown pistol product comprising a plated nose portion having a green color. In one embodiment, the projectile described herein is used in a rifle product. In one embodiment, an optional knurled cannelure may be added to the projectile. The ability to add a cannelure is a function of the ductile nature of the projectile made according to this disclosure.

It will be apparent to those skilled in the art that various modifications and variations can be made to the disclosed alloy and method of forming the alloy into a finished part without departing from the scope of the disclosure. Other embodiments of the invention will be apparent to those skilled in the art from consideration of the specification and practice of the invention disclosed herein. It is intended that the specification and examples be considered as exemplary only, with the true scope of the invention being indicated by the following claims and their equivalents.

What is claimed is:

1. A method of making a colored projectile, said method comprising:

mechanically plating a metal onto the surface of the projectile, wherein said plating comprises:

adding the projectile to a container comprising an aqueous slurry comprising at least one acid, at least one plating-assisting agent, and at least one particulate plating metal;

rotating the container to agitate the projectile in said slurry for a time sufficient to plate the particulate plating metal on the surface of said projectile to form a plated projectile;

rinsing the plated projectile; and treating the rinsed projectile with a composition comprising at least one chromium compound, water-soluble polymer and dyes to the surface of said projectile.

2. The method of claim 1, wherein said projectile is pre-treated prior to plating to clean the surface of unwanted contaminants chosen from oils, oxides, scale, and combinations thereof.

3. The method of claim 2, wherein pre-treatment comprises placing the projectile in at least one alkaline based solution, acid based solution, water rinse, or combinations thereof.

4. The method of claim 3, wherein pre-treatment in an acid based solution occurs in the container used for plating prior to adding at least one plating-assisting agent, or at least one particulate plating metal to the container, wherein the acid based solution comprises at least one acid chosen from sulfuric, hydrochloric and citric acids.

5. The method of claim 1, wherein the projectile is agitated in a slurry comprising said at least one acid to remove oxides from the surface of the bullet prior to the addition of at least one plating agent, and at least one particulate plating metal.

6. The method of claim 1, further comprising adding impact media to the container prior to rotating, wherein the impact media comprises a mixture of spherical glass beads ranging in size from 0.3 mm to 5.0 mm.

7. The method of claim 6, wherein the impact media is added in a substantially equal quantity, by volume, to the projectile.

8. The method of claim 1, wherein the temperature of the solution in the container ranges from 70° F. to 80° F.

9. The method of claim 1, wherein the at least one particulate plating metal has a diameter ranging from 3 to 20 microns in diameter.

10. The method of claim 1, wherein the aqueous slurry used for plating has a pH of 2.0 or less.

11. The method of claim 1, wherein the at least one plating-assisting agent comprises a coppering agent, an accelerator, a chemical promoter or combinations thereof.

12. The method of claim 1, wherein the particulate plating metal comprises zinc, tin, copper or aluminum.

13. The method of claim 1, wherein the composition compound imparts a desired color chosen from red, blue, green, yellow, orange, purple, and combinations thereof.

14. The method of claim 1, wherein the projectile contains a cohesive microstructure that is substantially free of intermetallics and exhibits a density ranging from 7.0 to 8.2 g/cc.

15. The method of claim 1, wherein the projectile comprises a frangible metal bullet comprising a compacted mixture of copper powder comprising partially sintered particles that are physically bonded to each other to form a cohesive and ductile microstructure.

16. The method of claim 15, wherein the frangible metal bullet is lead free.

17. The method of claim 15, which further comprises a step to cannelure a groove into the frangible metal bullet.

18. The method of claim 1, wherein the projectile comprises a full metal jacket or a total metal jacket bullet.

19. A method of making a colored frangible bullet, said method comprising:

mechanically plating a metal onto the surface of a frangible metal bullet, the frangible metal bullet comprising a compacted mixture of copper powder comprising partially sintered particles that are physically bonded to each other to form a cohesive and ductile microstructure, wherein said plating comprises:

adding the frangible metal bullet to a container comprising an aqueous slurry comprising at least one acid, at least one plating-assisting agent, and at least one particulate plating metal;

rotating the container to agitate the frangible metal bullet in said slurry for a time sufficient to plate the particulate plating metal on the surface of said frangible metal bullet to form a plated frangible metal bullet;

rinsing the plated frangible metal bullet; and treating the rinsed bullet with a composition comprising at least one chromium compound, water-soluble polymer and dyes to the surface of said plated frangible metal bullet.

20. A projectile made according to the method of claim 1, said projectile selected from a frangible bullet, a full metal jacket bullet, or a total metal jacket bullet.

* * * * *